US005111800A

United States Patent [19]

Reynolds

[11] Patent Number: 5,111,800

[45] Date of Patent: May 12, 1992

[54] BOWHUNTER'S GROUND BOW HOLDER

[76] Inventor: Gary E. Reynolds, 1114 S. 9½ St., Monmouth, Ill. 61462

[21] Appl. No.: 630,276

[22] Filed: Dec. 17, 1990

[51] Int. Cl.[5] ..... A45F 3/44

[52] U.S. Cl. ..... 124/88; 248/156; 248/122

[58] Field of Search ..... 124/1, 23.1, 86, 88, 124/89; 248/122, 156

[56] References Cited

U.S. PATENT DOCUMENTS

| | | | |
|---|---|---|---|
| 3,007,581 | 11/1961 | Moore | 248/156 |
| 3,204,626 | 9/1965 | Morneau | 124/88 X |
| 3,286,961 | 11/1966 | Mandolare | 248/122 X |
| 3,441,241 | 4/1969 | Brooks | 248/156 |
| 3,584,820 | 6/1971 | Butcher, Sr. | 248/156 X |
| 4,360,179 | 11/1982 | Roberts | 124/23.1 |
| 4,474,296 | 10/1984 | Hartman | 124/23.1 |
| 4,542,873 | 9/1985 | Matherly et al. | 124/23.1 |
| 4,846,140 | 7/1989 | DiMartino | 124/86 X |
| 4,896,854 | 1/1990 | St. Laurent | 248/156 |

*Primary Examiner*—Peter M. Cuomo
*Assistant Examiner*—Jeffrey L. Thompson
*Attorney, Agent, or Firm*—Henderson & Sturm

[57] ABSTRACT

A new device designed for holding bows of all types for bowhunters which hunt from the ground. This can be conveniently made from inexpensive materials comprising hardwoods, aluminum channeling, and a assortment of wood screws, washers, bolts, nuts, and several hanger bolts with some steel rod. Its main function is to assist the hunter afield by providing the perfect bow holding spot and position anywhere and on any type terrain. Many other uses may be discovered or what may be obvious to the novice. This device includes complete adjustable bow holding or hanging status among its entire members to provide comfortable bow hunting upon the ground.

2 Claims, 2 Drawing Sheets

BOWHUNTER'S GROUND BOW HOLDER

BACKGROUND OF THE INVENTION

1. Field of the Invention

The invention is a new device which facilitates easy holding and positioning of a bowhunter's bow while hunting from the ground in most all types of terrain.

2. Description of the Prior Art

To this day most bowhunters would rely upon what ever was handy to lean their bows against and usually find it hard to find that first sought after position. In some cases where good hunting hiding spots are apparent there usually doesn't exist a good place to position or hang up a bow for readiness. This new device provides a place to hang a bowhunter's bow and also allows adjustability in the correct desired positioning of the bow to meet the hunter's needs. Before, ground hunting has been stressful because of tired arms from holding heavier bows such as compound bows as well as other models too. With this new device these things are accomplished where before have been difficult and stressful which are:

1. Provides a place to hang hunter's bow when there is no apparent place to hang it.
2. Adjusts to hunter's desired needs in heights and pitch for readiness.
3. By helping hunters from fatigue or becoming fatigued early into hunts.
4. In some cases a special device design may be needed, if so a custom fit can be made.
5. Device provides a means for transportation by a strap for convenience of travel while hunting.
6. A pull apart device design will also add needed features while going to and from hunting areas as well as storage purposes.

It is the object of this invention to provide that needed place to hang the hunter's bow no matter what ground position and place he or she may choose to hunt from, including the full adjustment of the positioning of the bow for readiness.

SUMMARY OF THE INVENTION

The invention is a new device which will aid bowhunters that prefer to ground hunt in most all terrain. The invention comprises useful features where before a propped up bow was all that was available and usually in an undesired position. It comprises a means for attaching the invention to the ground, an adjustable means and support members.

It is an object of the invention to provide a more convenient means for bowhunters to position their bows while hunting from the ground regardless of terrain and being inexpensive to manufacture, invention will also improve hunting conditions.

DESCRIPTION OF THE PREFERRED EMBODIMENT

Figure 1:
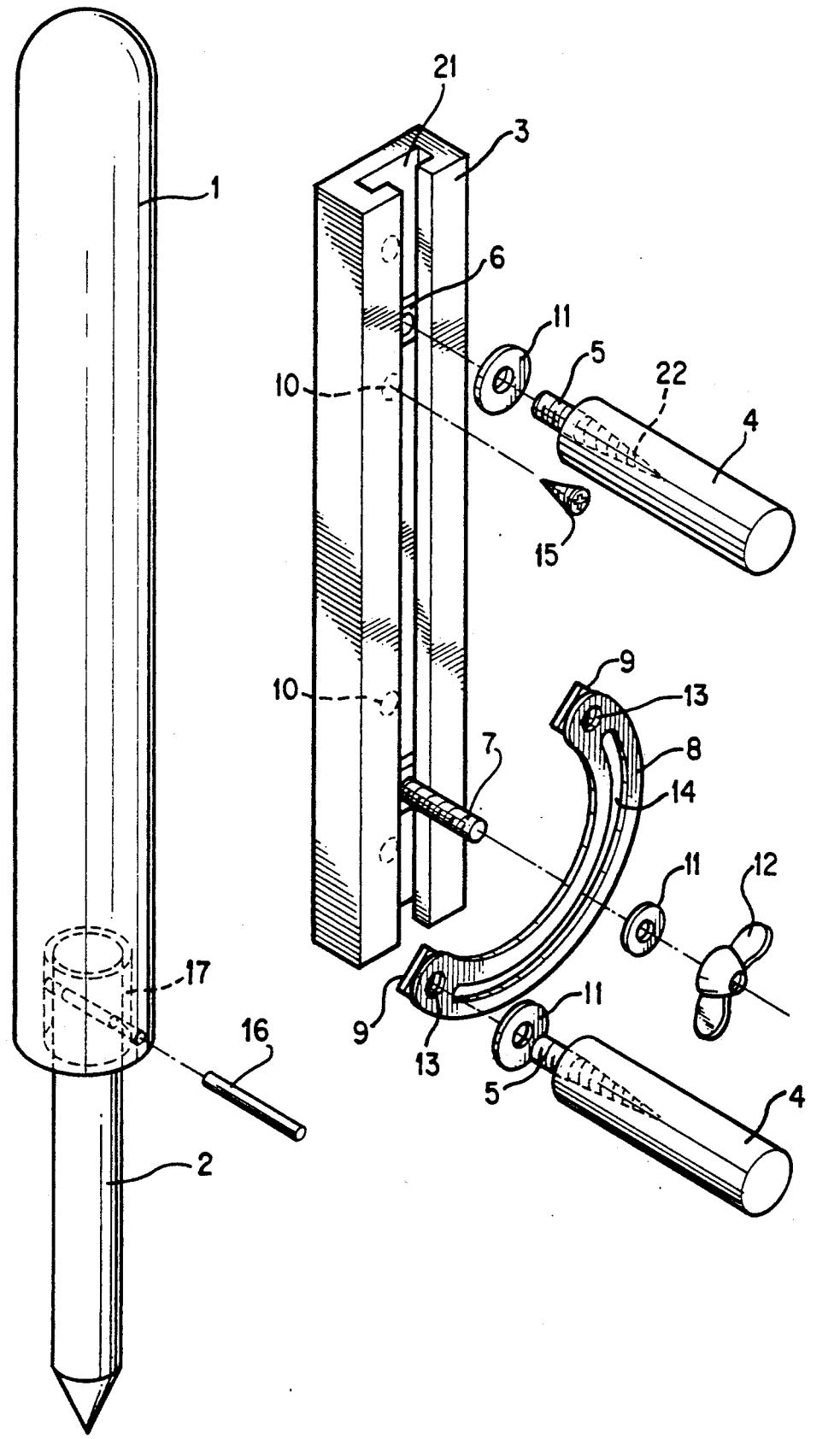
FIG. 1 is a plan view of the device as a whole in an exploded piece-by-piece version.

Referring to FIG. 1 the pole 1 is recognized as the main support structure with the number 2 member being adjacent thereof providing a means for attaching the entire invention to the ground and is permanently attached to the bottom of the pole 1 by the use of a spring pin 16 through the pole 1 and member 2 after member 2 has been inserted into opening 17 at the bottom of the pole 1 which is of a gauged tolerance in depth and width for a tight fit giving the invention good strength. Some epoxy glue at obvious places during making of the device shall be current through out FIG. 1 and FIG. 2 to provide good craftsmanship of the invention.

Figure 2:
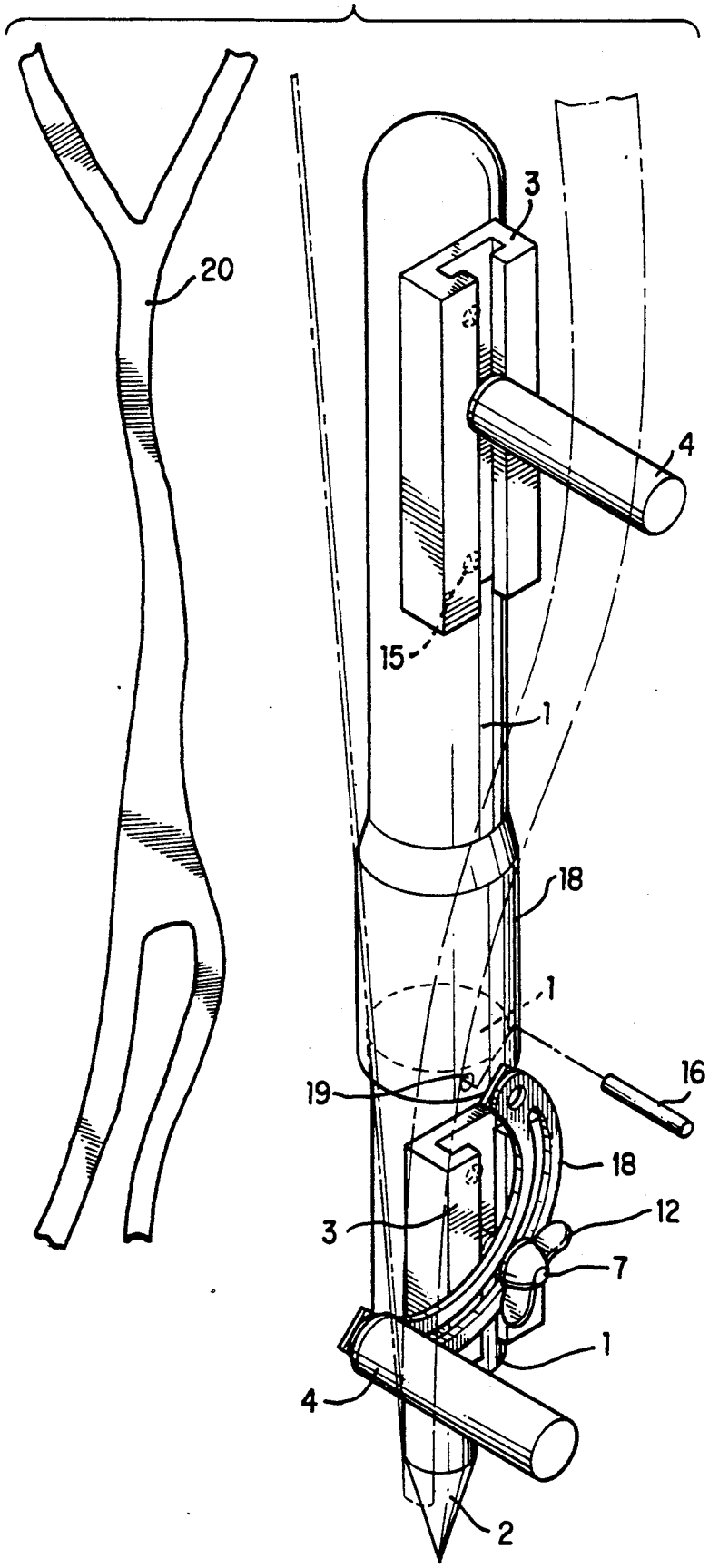
FIG. 2 is an assembled view of the device with a bow in place and a means for seperation of the device at numbers indicated which are 1 and 18.

Referring to FIG. 2 the number 20 points out a strap of a wrap around and tie nature having two loose ends at each end of the strap for use in tying around the invention as one piece or two pieces for transportation purposes. FIG. 2 introduces structure 18 as a receptacle for structure 1 which works together to make a take-down device. Structure 18 is permanently affixed to the top half of the bottom portion of structure 1 in the same fashion as member 2 in FIG. 1 by the use of a spring pin 16 and epoxy glue. Pin 16 inserts through numbered opening 19 in structure 18 with structure 1's top half of bottom portion inserted retrospectively.

FIG. 2 is actually in a sense a form of FIG. 1 to help further understand the invention. FIG. 2 has been actually cut in half and a new structure 18 added with a little prearrangement of other structures to form a come-apart device.

FIG. 2 will perform identical in all functional member's as FIG. 1 with one exception being that FIG. 2 comes apart in the middle.

Referring back to FIG. 1 the member's support structure 3 attaches at a predetermined position on the pole structure 1 which in turn receives all remaining actuating members which will permute up and down the channeled structure 3 as so desired. The attaching of channeled structure 3 including predetermined countersunk drilled openings in the structure 3 which is referred to as the number 10 in FIG. 1 to receive screw members 15 through the openings and into the pole 1 causing the means for attachment.

After the attachment of 3 to 1, member square nut 6 is inserted into channel opening 21 atop of structure 3. Hanger bolt 5 then receives rubber surfaced washer 11 together they are screwed into 6 but, not before wooden dowel 4 is screwed onto hanger bolt screw end 22. Together 6, 11, 5, and 4 make up a member of permutation.

Just by twisting member 4 back and forth allows entire member 4 to permute up and down structure 3.

Referring to the predetermined square-headed bolt member 7 inserts into 3 at bottom of 3 sliding up to receive first a curved slotted bracket 8 which includes welded on nuts 9 at each end of bracket 8. Through bracket 8's slot, numbered 14, member 7 comes out to receive member 11 and a wing nut member 12. Together members 7, 11, and 12 attach member 8 to 3 allowing the bracket to slide as to permute just by loosening or tightening wing nut 12. A pitching adjustment of bracket 8 is made also by controlling wing nut 12.

Still referring to FIG. 1 bracket 8 will receive 11, 5, and 4 at either end where welded nut 9 is. At each end of 8 there has been a predetermined hole 13 made in which the welded nut 9 is welded.

By assembling 11, 5, and 4 into hole 13 and welded nut 9 on slotted bracket 8 which is attached to 3, member is now ready to actuate as to permute up and down 3.

FIG. 2 resembling the most assembled view illustrates how the top member 4 acts as a height adjustment member. With the top of a bow positioned on the dowel 4 between the string and bow limb the bow can be raised or lowered while resting on the dowel.

The bottom member 4 attached there to acts as a bow positioning or leveling member upon the device. With both of the latter members 4 working together upon the structures 1, 2, and 3 the invention functions, holding a hunter's bow in his or her desired position upon the ground while hunting.

I claim:

1. A device for holding all styles of bows for bowhunters who hunt from the ground which comprises:

(a) a pole;

(b) an elongated support structure having a slotted open channel along the length of a first side and a plurality of holes spaced along the length of a second side, the support structure being connected to the pole by a plurality of connecting means extending through said holes;

(c) a plurality of adjustable support members spaced along the elongated support structure, each member having attachment means for selectively attaching the member to the slotted open channel of the support structure in a plurality of selected positions along the length of the channel and each member having an engagement means for engaging and supporting a bow in a selected position; and (d) means affixed to the bottom of the pole for insertion into the ground to fix the pole to the ground in an upright position.

2. A device for holding all styles of bows for bowhunters who hunt from the ground which comprises:

(a) an elongated two-section pole having a connection means along a mid-portion thereof for connecting the two sections together, the connection means allowing the pole to be separated into its two sections for easier transportation and storage;

(b) first and second elongated support structures each having a slotted open channel along the length of a first side thereof and a plurality of holes spaced along the length of a second side thereof, the first and second support structures being connected to a respective one of the pole sections by a plurality of connecting means extending through said holes;

(c) first and second support members adjustably attached one to each of said first and second support structures, each member having attachment means for selectively attaching the member to the slotted open channel of a respective one of the support structures in a plurality of selected positions along the length of the channel and each member having an engagement means for engaging and supporting a bow in a selected position; and (d) means affixed to the bottom of the pole for insertion into the ground to fix the pole to the ground in an upright position.

* * * * *